US011591767B2

(12) United States Patent
Bai et al.

(10) Patent No.: US 11,591,767 B2
(45) Date of Patent: Feb. 28, 2023

(54) DEVICE AND METHOD FOR TESTING COMPRESSION AMOUNT OF PILE BODY OF ROCK-SOCKETED CAST-IN-PLACE PILE

(71) Applicant: Qingdao University of Technology, Qingdao (CN)

(72) Inventors: Xiaoyu Bai, Qingdao (CN); Nan Yan, Qingdao (CN); Yamei Zhang, Qingdao (CN); Mingyi Zhang, Qingdao (CN); Cuicui Li, Qingdao (CN); Yongfeng Huang, Qingdao (CN); Yonghong Wang, Qingdao (CN); Xiang Fang, Qingdao (CN); Yujin Jiao, Qingdao (CN); Lin Yang, Qingdao (CN)

(73) Assignee: Qingdao University of Technology, Qingdao (CN)

( * ) Notice: Subject to any disclaimer, the term of this patent is extended or adjusted under 35 U.S.C. 154(b) by 0 days.

(21) Appl. No.: 17/678,723

(22) Filed: Feb. 23, 2022

(65) Prior Publication Data

US 2022/0275600 A1 Sep. 1, 2022

(51) Int. Cl.
*E02D 33/00* (2006.01)
*E02D 5/38* (2006.01)

(52) U.S. Cl.
CPC ..... *E02D 33/00* (2013.01); *E02D 5/38* (2013.01); *E02D 2600/10* (2013.01)

(58) Field of Classification Search
CPC combination set(s) only.
See application file for complete search history.

(56) References Cited

U.S. PATENT DOCUMENTS 10,823,880 B1 * 11/2020 Gupta ..... G01V 99/005
2016/0251819 A1 * 9/2016 Dinh ..... E02D 33/00 73/784
2021/0102863 A1 * 4/2021 Moghaddam ..... G01M 5/0058

FOREIGN PATENT DOCUMENTS

CN 108225264 A 6/2018
CN 110258663 A 9/2019
(Continued)

OTHER PUBLICATIONS

The State Intellectual Property Office of People's Republic of China, First Office Action, Application No. 202110217171.X, dated Dec. 27, 2021, in 10 pages.
(Continued)

*Primary Examiner* — Kyle Armstrong
(74) *Attorney, Agent, or Firm* — Procopio, Cory, Hargreaves & Savitch LLP

(57) ABSTRACT

A device and a method for testing a compression amount of a pile body of a rock-socketed cast-in-place pile is provided. The testing device includes open flexible pipes which are correspondingly bound with two main reinforcements in the pile body of the rock-socketed cast-in-place pile, and lengths of the open flexible pipes are the same as those of the bound main reinforcements. One end of each of the two open flexible pipes is located at a bottom end of a corresponding main reinforcement and fixedly connected with a first sealing sheet, and other ends of the two open flexible pipes are located at a top portion of the rock-socketed cast-in-place pile and fixedly connected with second sealing sheets. A closed rigid pipe is located in the open flexible pipe, and pipe bodies of the closed rigid pipe and the open flexible pipe are not in contact.

18 Claims, 5 Drawing Sheets

(56) References Cited

FOREIGN PATENT DOCUMENTS

| | | | | |
|---|---|---|---|---|
| CN | 210830919 | U | | 6/2020 |
| KR | 100774777 | B1 | * | 11/2007 |
| KR | 20150028744 | A | * | 3/2015 |

OTHER PUBLICATIONS

The State Intellectual Property Office of People's Republic of China, Notification to Grant Patent Right for Invention, Application No. 202110217171.X, dated Apr. 1, 2022.

* cited by examiner

DEVICE AND METHOD FOR TESTING COMPRESSION AMOUNT OF PILE BODY OF ROCK-SOCKETED CAST-IN-PLACE PILE

CROSS REFERENCE TO RELATED APPLICATION

This patent application claims the benefit and priority of Chinese Patent Application No. 202110217171.X, filed on Feb. 26, 2021, the disclosure of which is incorporated by reference herein in its entirety as part of the present application.

TECHNICAL FIELD

The present disclosure belongs to the technical field of pile foundation testing, and particularly relates to a device and a method for testing the compression amount of a pile body of a rock-socketed cast-in-place pile.

BACKGROUND ART

The statements in this section merely provide background information related to the present disclosure and do not necessarily constitute the prior art.

The size and height of urban buildings are also increased year by year, so that the requirement for pile foundation bearing capacity is higher and higher, the required foundation embedded depth is also continuously increased, and therefore pile foundations (especially cast-in-place piles) are inevitably embedded into stable rock mass through soft soil layers to form rock-socketed piles.

According to the rock-socketed cast-in-place pile, a section of the lower portion of the pile body is embedded into a medium-weathered rock stratum, a micro-weathered rock stratum or a medium-micro-weathered rock stratum. The bearing capacity is composed of three parts, namely side friction of soil around the pile, side friction of a rock-socketed section and end resistance of the rock-socketed section respectively. The detection of the vertical compressive bearing capacity of the single pile of the rock-socketed cast-in-place pile mainly takes a static load test as the principle things, since the characteristic value of the bearing capacity of the single pile obtained by the static load test is most reliable. The pile top settlement measured by the static load test consists of two parts, namely pile bottom displacement and pile body compression displacement under the action of load. At present, the static load test mainly tests pile top displacement, and pile bottom displacement is overestimated due to the fact that pile body compression amount is not tested. The influence of pile body damage on the ultimate bearing capacity of the pile foundation is ignored, and at the moment, the judgment on the ultimate bearing capacity of the pile foundation by only using the pile top load-pile top settlement index is one-sided too much and not reasonable enough. Then, under the action of the load, the load of the pile foundation is gradually transmitted from the pile top to the pile end, and the pile body of the rock-socketed part of the rock-socketed cast-in-place pile is gradually compressed under the counter-acting force of the rock mass. Therefore, a device and a method for testing the compression amount of a pile body of a rock-socketed cast-in-place pile and the compression amount of the pile body of the rock-socketed section of the rock-socketed cast-in-place pile are urgently needed, on the basis, the corresponding relation between the compression amount of the pile body and the ultimate bearing capacity of the pile foundation is established, the characteristic value of the single-pile bearing capacity of the rock-socketed cast-in-place pile can be accurately determined, and engineering safety and normal use are ensured.

At present, according to a common method for measuring the pile body compression amount, fiber bragg grating strain sensors are pasted on main reinforcements in a reinforcement cage to measure pile body deformation, and the measured result is true and reliable, but the result reflects the local deformation amount of the pile body but not the whole body compression amount of the cast-in-place pile. In addition, a method for placing a settlement rod in an outer sleeve is adopted, the outer sleeve is connected with concrete and is compressed along with the concrete, the settlement rod is not in contact with the outer sleeve and overhangs the pile, the final pile body compression amount is expressed by utilizing the displacement difference of the whole process of the settlement rod, but the static load test is not easy to carry out outside the pile at the overhanging position of the settlement rod. In addition, the outer sleeve is a rigid steel pipe, compression of the rigid steel pipe can damage the concrete pile body, certain errors exist in measurement through an observation method, and the whole process of the foundation pile under the action of load cannot be observed and analyzed. So far, a method for measuring the compression amount of a pile body of a rock-socketed cast-in-place pile and the compression amount of the pile body of the rock-socketed section of the rock-socketed cast-in-place pile is lacked.

In conclusion, the inventor discovers that how to continuously and accurately measure the compression amount of the pile body of the rock-socketed cast-in-place pile in real time while guaranteeing that initial defects are not caused to the rock-socketed cast-in-place pile is the key technical problem in the technical field of pile foundation testing at present.

SUMMARY

In order to solve the technical problems in the background art, the present disclosure provides a device and a method for testing the compression amount of a pile body of a rock-socketed cast-in-place pile, and the device and the method can accurately measure the compression amount of the pile body of the rock-socketed cast-in-place pile on the premise that the rock-socketed cast-in-place pile is not damaged.

In order to achieve the above purpose, the present disclosure adopts the following technical scheme:

On one hand, the present disclosure provides a device for testing the compression amount of a pile body of a rock-socketed cast-in-place pile.

The device for testing the compression amount of a pile body of a rock-socketed cast-in-place pile comprises open flexible pipes, closed rigid pipes, first sealing sheets, second sealing sheets and displacement sensors;

the open flexible pipes are correspondingly bound with two main reinforcements in the pile body of the rock-socketed cast-in-place pile, and the lengths of the open flexible pipes are the same as those of the bound main reinforcements; the length of one of the main reinforcements is the height of the rock-socketed cast-in-place pile, and the length of the other of the main reinforcements is the height of the rock-socketed cast-in-place pile minus the height of a rock stratum; one end of each of the two open flexible pipes is located at the bottom end of the corresponding main reinforcement and fixedly connected with the first sealing sheet, and the other ends of the two open flexible pipes are located at the top portion of the rock-socketed cast-in-place pile and fixedly connected with the second sealing sheets; the closed rigid pipe is located in the open flexible pipe, pipe bodies of the closed rigid pipe and the open flexible pipe are not in contact, and the bottom end of the closed rigid pipe and the bottom end of the open flexible pipe are connected together through the first sealing sheet; one end of each of the displacement sensors is fixedly connected with the second sealing sheet, the other ends of the displacement sensors are connected with the top ends of the closed rigid pipes, and the top ends of all the closed rigid pipes are always kept at the same height; and the displacement sensors are used for measuring the relative displacement of the first sealing sheets and the second sealing sheets, namely the compression amount of the pile body.

As a mode of execution, the displacement sensor is a fiber bragg grating displacement sensor, and the fiber bragg grating displacement sensor further penetrates through a PVC pipe and then is connected with a fiber bragg grating demodulator through an armored optical fiber.

The scheme has the advantage that the fiber bragg grating displacement sensor can guarantee the real-time performance, continuity and accuracy of measurement.

As a mode of execution, a positioner is further installed on the closed rigid pipe and used for guaranteeing that the closed rigid pipe is always located at the central position of the open flexible pipe.

The scheme has the advantages that due to the fact that the diameters of the closed rigid pipe and the open flexible pipe are different, a gap exists between the closed rigid pipe and the open flexible pipe and the pipe length is long, the phenomena of contact or displacement, bending and the like of an inner pipe are inevitably generated, the positioner can guarantee that the closed rigid pipe and the open flexible pipe are concentric, compression of the open flexible pipe is not limited, and therefore the measurement accuracy is improved.

As a mode of execution, the positioner comprises an upper annular sheet, a lower annular sheet and balls, the balls are uniformly distributed between the open flexible pipe and the closed rigid pipe, and two ends of the balls are fixed by the upper annular sheet and the lower annular sheet respectively.

The scheme has the advantages that the structure is simple and the closed rigid pipe and the open flexible pipe always can be kept concentric.

As a mode of execution, gaps between the balls and the open flexible pipe, between the balls and the closed rigid pipe and between the upper annular sheet and the lower annular sheet are filled with lubricating grease.

The scheme has the advantage that by adopting the lubricating grease, damage to the open flexible pipe and the closed rigid pipe when the pile body of the rock-socketed cast-in-place pile is compressed can be avoided, and the operational stability of equipment is improved.

As a mode of execution, the device for testing the compression amount of a pile body of a rock-socketed cast-in-place pile further comprises a horizontal plate, the horizontal plate is arranged at the upper ends of the second sealing sheets, and a level detector is arranged on the horizontal plate and used for detecting whether the top ends of all the closed rigid pipes are kept at the same height or not.

The scheme has the advantage that the top ends of all the closed rigid pipes are kept at the same height and are the foundation for guaranteeing the compression amount precision of the pile body of the rock-socketed cast-in-place pile.

As a mode of execution, the device for testing the compression amount of a pile body of a rock-socketed cast-in-place pile further comprises a hoop, the hoop is arranged at the upper ends of the second sealing sheets and used for limiting compression deformation of the concrete pile body on the upper portions of the open flexible pipes.

The scheme has the advantage that, in order to prevent the open flexible pipes from overhanging out of the pile, the open flexible pipes are designed in the pile body, the static loading process can be conveniently and smoothly implemented, and the compression amount of the pile body on the upper portions of the open flexible pipes can be ignored.

As a mode of execution, the hoop is of an annular structure, the outer diameter is the same as the pile diameter, and the inner diameter is ⅔ of the pile diameter.

As a mode of execution, the length of the closed rigid pipe is the length of the open flexible pipe minus the length of the displacement sensor and then plus a set length threshold value.

The scheme has the advantages that the set length threshold considers the need for pre-compression of the displacement sensors, and the displacement sensors are prevented from being not in contact with the closed rigid pipes.

On the other hand, the present disclosure provides a testing method adopting a device for testing the compression amount of a pile body of a rock-socketed cast-in-place pile, comprising the following steps:

carrying out a static load test by using the device for testing the compression amount of a pile body of a rock-socketed cast-in-place pile according to any one of claims 1 to 9 to obtain the pile body compression amount $\alpha_1$ of the whole pile and the pile body compression amount $\alpha_2$ above the rock-socketed section; and subtracting the pile body compression amount $\alpha_2$ above the rock-socketed section from the pile body compression amount $\alpha_1$ of the whole pile to obtain the compression amount $\alpha$ of the rock-socketed cast-in-place pile in a rock stratum is obtained and finally obtain Q-$\alpha_1$ and Q-$\alpha$ curves, wherein Q is the balance weight of the static load test.

The present disclosure has the following beneficial effects:

The testing device for the compression amount of the pile body of the rock-socketed cast-in-place pile is an indirect measuring device, the open flexible pipes are tightly connected with the concrete of the pile body of the rock-socketed cast-in-place pipe, and the open flexible pipes are flexible pipes, so that the damage to the concrete caused by the outer steel pipe in the compression process can be avoided; moreover, the open flexible pipe deforms along with the rock-socketed cast-in-place pile, when the pile body is compressed and deformed, the relative displacement of the first sealing sheets and the second sealing sheets is changed, the lengths of the closed rigid pipes are not changed, and by obtaining the spring compression in the displacement sensors abutting against the top ends of the closed rigid pipes, the spring compression amount is the pile body compression amount; and therefore, the purpose that the compression amount of the pile body of the rock-socketed cast-in-place pile can be accurately measured on the premise that the rock-socketed cast-in-place pile is not damaged is achieved.

The additional aspects and advantages of the present disclosure will be set forth partially in the following description, and will be apparent from the following description, or learned through the practice of the present disclosure.

BRIEF DESCRIPTION OF THE DRAWINGS

Attached figures of the description which form a part of the present disclosure are used for providing further understanding of the present disclosure, and the illustrative embodiments and description thereof in the present disclosure are used for explaining the present disclosure and are not to be construed as an undue limitation of the present disclosure.

Reference signs: 1, rock-socketed cast-in-place pile; 2, main reinforcement; 3, iron wire; 4, hoop; 5, open flexible pipe; 6, first sealing sheet; 7, closed rigid pipe; 8, positioner; 9, fiber bragg grating displacement sensor; 10, second sealing sheet; 11, horizontal plate; 12, PVC pipe; 13, armored optical fiber; 14, fiber bragg grating demodulator; 15, cable; 16, computer; 17, upper annular sheet; 18, ball; 19, lubricating grease; 20, lower annular sheet; 21, transverse pipe; 22, vertical pipe; 23, L-shaped converter; 24, level detector; 25, balance weight; 26, steel beam; 27, jack; 28, displacement measuring instrument; 29, datum line beam; 30, high-pressure oil pipe; 31, oil pump controller; 32, static load tester; and 33, top portion.

DETAILED DESCRIPTION OF THE EMBODIMENTS

The present disclosure is further described in conjunction with the attached figures and embodiments.

It should be noted that the following detailed description is exemplary and aims to provide further description for the present disclosure. Except as otherwise noted, all techniques and scientific terms used in the present disclosure have same meanings generally understood by ordinary skill in the art in the present disclosure.

It needs to be noted that the terms used herein just describe the specific mode of execution, but not expect to limit the exemplary modes of execution in the disclosure. It is to be understood that the singular forms "a", "an", and "the" include plural referents unless the context clearly dictates otherwise. Moreover, it should be understood that the terms "contain" and/or "comprise" used in the specification indicate characteristics, steps, operations, devices, assemblies and/or their combination.

In the present disclosure, the indicative direction or position relations of the terms such as "upper", "lower", "left", "right", "front", "back" "vertical", "horizontal", "side" and "bottom" are direction or position relations illustrated based on the attached figures, just for facilitating the description of the relational words determined by the structural relationships of parts or elements in the present disclosure, but not for indicating or hinting any part or element in the present disclosure, and the terms cannot be understood as the restriction of the present disclosure.

In the present disclosure, the terms such as "fixedly connect", "link" and "connect" should be generally understood, for example, the components can be fixedly connected, and also can be detachably connected or integrally connected; and the components can be directly connected, and also can be indirectly connected through an intermediate. For related scientific research or technical staff in the art, the specific meaning of the above terms in the present disclosure can be determined in accordance with specific conditions, but cannot be understood as the limitation of the present disclosure.

Figure 1:
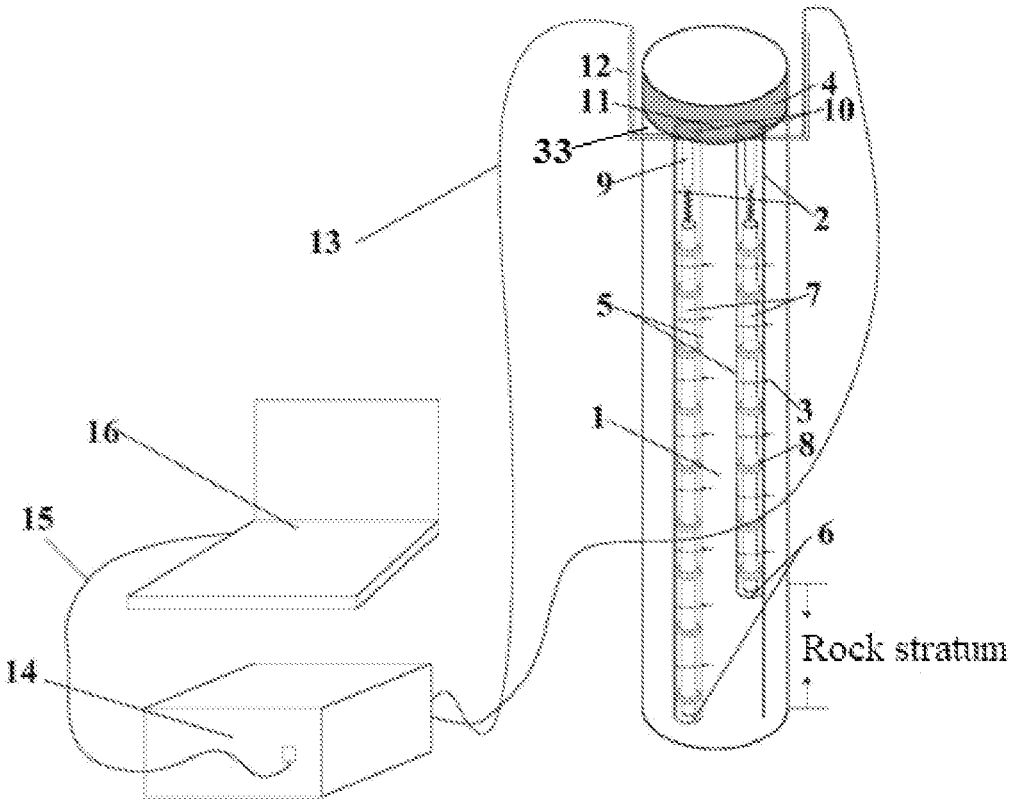
FIG. 1 is a space diagram of a device for testing the compression amount of a pile body of a rock-socketed cast-in-place pile in a rock stratum provided by the embodiment of the present disclosure.

As shown in FIG. 1, the device for testing the compression amount of a pile body of a rock-socketed cast-in-place pile in the embodiment comprises open flexible pipes 5, closed rigid pipes 7, first sealing sheets 6, second sealing sheets 10 and displacement sensors.

It should be illustrated that the displacement sensor in the embodiment is a fiber bragg grating displacement sensor 9, and the fiber bragg grating displacement sensor 9 further penetrates through a PVC pipe 12 and then is connected with a fiber bragg grating demodulator 14 through an armored optical fiber 13. The fiber bragg grating displacement sensor can guarantee the real-time performance, continuity and accuracy of measurement.

Wherein, the fiber bragg grating demodulator 14 is connected with a computer 16 through a cable 15.

Figure 6:
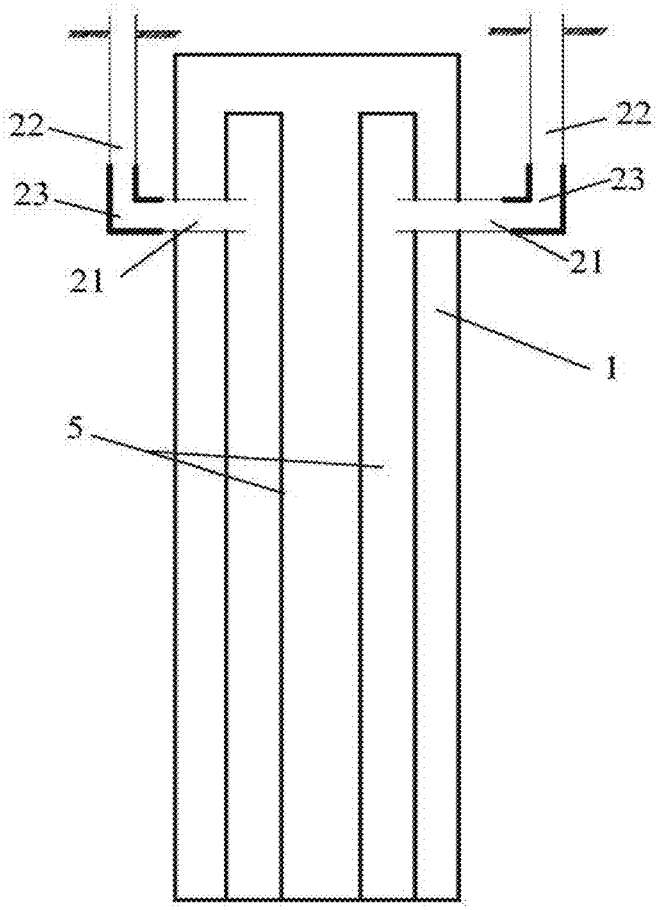
FIG. 6 is a structural front view of an open flexible pipe, a rock-socketed cast-in-place pile and a PVC pipe provided by the embodiment of the present disclosure.

As shown in FIG. 6, the PVC pipe 12 comprises a transverse pipe 21, an L-shaped converter 213 and a vertical pipe 22 which are connected in sequence. Wherein, the lengths of the transverse pipes 21 and the vertical pipes 22 are determined according to actual engineering, and it can be guaranteed that the armored optical fiber can be led out of the ground.

In other embodiments, the displacement sensors can also be displacement sensors of other existing structures and can be specifically arranged by those skilled in the art according to actual situations, and details are not repeated herein.

In the embodiment, the open flexible pipes, the closed rigid pipes, the first sealing sheets and the second sealing sheets are all made of steel materials.

It can be understood that in other embodiments, the open flexible pipes, the closed rigid pipes, the first sealing sheets, and the second sealing sheets can also be made of other materials according to actual situations.

Specifically, the open flexible pipes 5 are correspondingly bound with two main reinforcements 2 in the pile body of the rock-socketed cast-in-place pile 1, and the lengths of the open flexible pipes 5 are the same as those of the bound main reinforcements 2; and the length of one of the main reinforcements is the height of the rock-socketed cast-in-place pile, and the length of the other of the main reinforcements is the height of the rock-socketed cast-in-place pile minus the height of a rock stratum. For example, the open flexible pipes 5 are bound together with the main reinforcements 2 with iron wires 3.

One end of each of the two open flexible pipes 5 is located at the bottom end of the corresponding main reinforcement and fixedly connected with the first sealing sheet 6, and the other ends of the two open flexible pipes 5 are located at the top portion 33 of the rock-socketed cast-in-place pile 1 and fixedly connected with the second sealing sheets 10.

When the first sealing sheets and the second sealing sheets are all made of steel materials, the open flexible pipes and the first sealing sheets can be fixedly connected in a welding mode; and the open flexible pipes and the second sealing sheets can also be fixedly connected in a welding mode.

Figure 5:
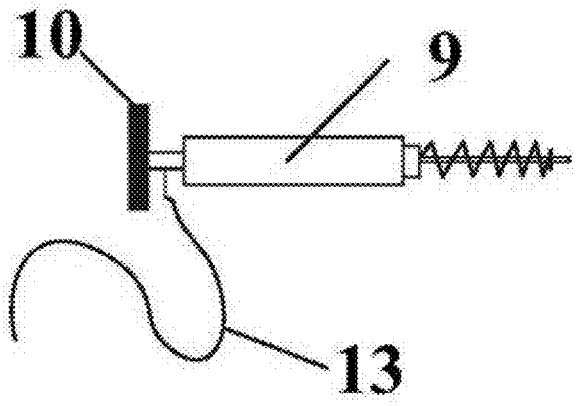
FIG. 5 is a structural front view of a fiber bragg grating displacement sensor combined with a sealing steel sheet provided by the embodiment of the present disclosure.

The closed rigid pipe 7 is located in the open flexible pipe 5, pipe bodies of the closed rigid pipe and the open flexible pipe are not in contact, and the bottom end of the closed rigid pipe 7 and the bottom end of the open flexible pipe 5 are connected together through the first sealing sheet 6; as shown in FIG. 5, one end of each of the displacement sensors (fiber bragg grating displacement sensor 9 as shown in FIG. 1) is fixedly connected with the second sealing sheet 10, the other ends of the displacement sensors are connected with the top ends of the closed rigid pipes 7, and the top ends of all the closed rigid pipes 7 are always kept at the same height; and the displacement sensors are used for measuring the relative displacement of the first sealing sheets 6 and the second sealing sheets 10, namely the compression amount of the pile body.

Specifically, the diameter of the pile body of the rock-socketed cast-in-place pile 1 is usually not smaller than 0.8 m (a large-diameter cast-in-place pile), and because the diameter of the internal open flexible pipe 5 is small, the influence on the bearing capacity of the rock-socketed cast-in-place pile 1 is small. For example, the diameter of the open flexible pipe 5 is 40 mm, and the diameter of the first sealing sheet 6 and the diameter of the second sealing sheet 10 are slightly larger than the diameter of the open flexible pipe 5 and can be set to be 41 mm.

In some embodiments, a positioner 8 is further installed on the closed rigid pipe 7 and used for guaranteeing that the closed rigid pipe is always located at the central position of the open flexible pipe. Due to the fact that the diameters of the closed rigid pipe and the open flexible pipe are different, a gap exists between the closed rigid pipe and the open flexible pipe and the pipe length is long, the phenomena of contact or displacement, bending and the like of an inner pipe are inevitably generated, the positioner can guarantee that the closed rigid pipe and the open flexible pipe are concentric, compression of the open flexible pipe is not limited, and therefore the measurement accuracy is improved.

Figure 2:
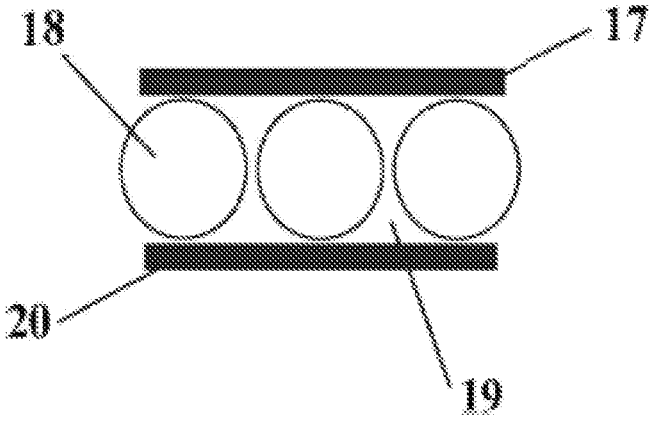
FIG. 2 is a structural front view of a positioner provided by the embodiment of the present disclosure.

As shown in FIG. 2, the positioner 8 comprises an upper annular sheet 17, a lower annular sheet 20 and balls 18, the balls 18 are uniformly distributed between the open flexible pipe 5 and the closed rigid pipe 7, and two ends of the balls 18 are fixed by the upper annular sheet 17 and the lower annular sheet 20 respectively. The positioner is simple in structure, and the closed rigid pipe and the open flexible pipe always can be kept concentric.

Figure 3:
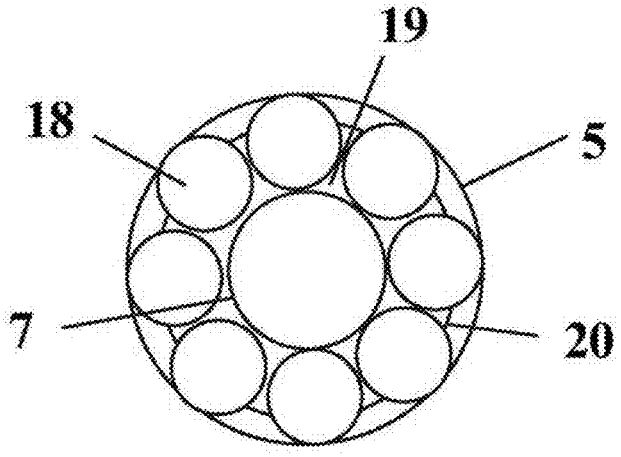
FIG. 3 is a structural top view of a positioner combined with an inner pipe and an outer pipe provided by the embodiment of the present disclosure.
Figure 4:
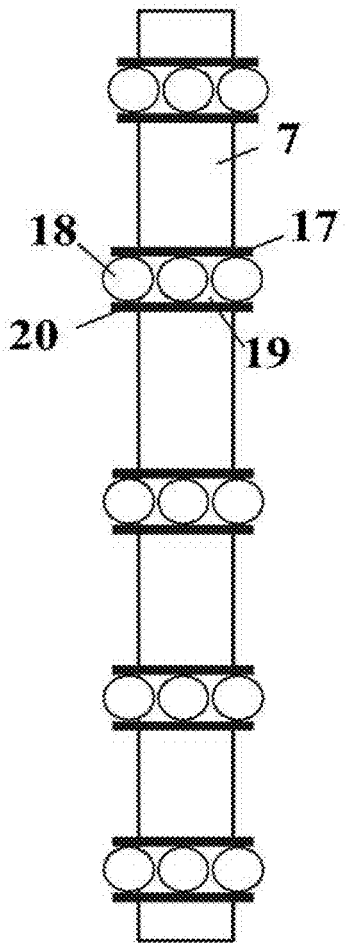
FIG. 4 is a structural front view of a closed rigid pipe combined with a positioner provided by the embodiment of the present disclosure.

In specific implementation, the upper annular sheets 17, the lower annular sheets 20 and the balls 18 are all made of steel materials, for example, the balls can be made of steel balls. Gaps between the balls 18 and the open flexible pipe 5, between the balls 18 and the closed rigid pipe 7 and between the upper annular sheet 17 and the lower annular sheet 20 are filled with lubricating grease 19, as shown in FIG. 3 and FIG. 4. Thus, by adopting the lubricating grease, damage to the open flexible pipe and the closed rigid pipe when the pile body of the rock-socketed cast-in-place pile is compressed can be avoided, and the operational stability of equipment is improved.

For example, the upper annular sheet 17 and the lower annular sheet 20 of the positioner 8 are both 20 mm in inner diameter (diameter) equal to the diameter of the closed rigid pipe 7, 15 mm longer than the inner diameter in outer diameter (diameter) and 2 mm in thickness, and the diameter of the ball 18 is 9 mm.

In some specific modes of execution, the device for testing the compression amount of a pile body of a rock-socketed cast-in-place pile further comprises a horizontal plate 11, the horizontal plate 11 is arranged at the upper ends of the second sealing sheets 10, and a level detector 24 is arranged on the horizontal plate 11 and used for detecting whether the top ends of all the closed rigid pipes are kept at the same height or not. Thus, the top ends of all the closed rigid pipes are kept at the same height and are the foundation for guaranteeing the compression amount precision of the pile body of the rock-socketed cast-in-place pile.

Figure 7:
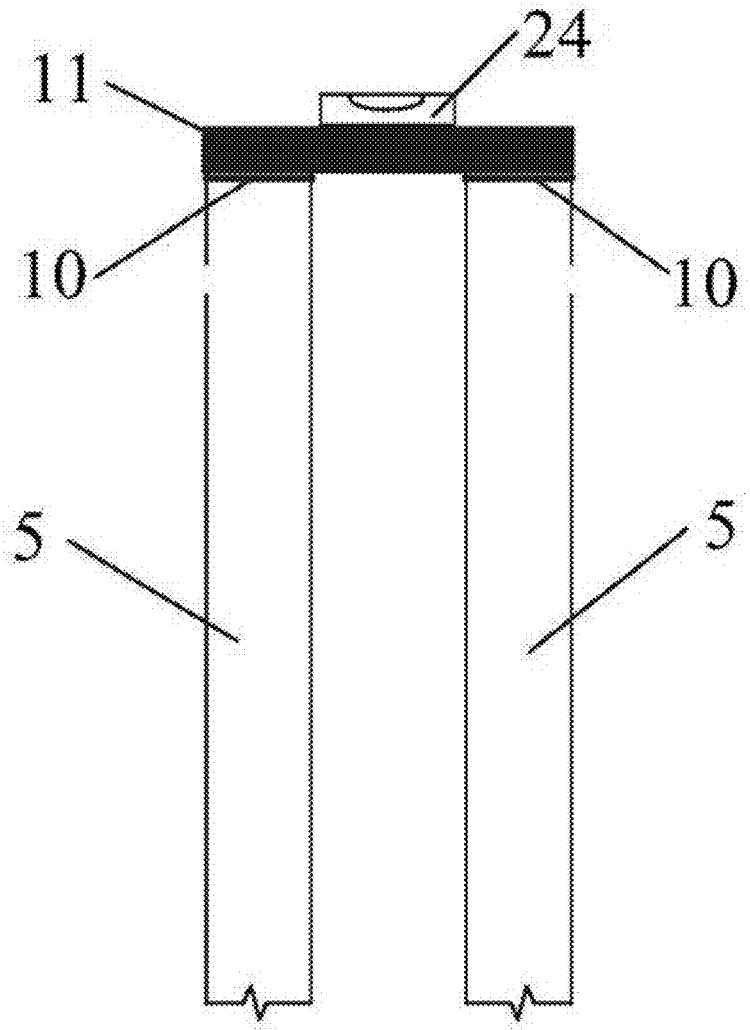
FIG. 7 is a structural front view of open flexible pipes, sealing steel sheets, a rectangular steel sheet and a level bubble detector provided by the embodiment of the present disclosure.

Wherein, the level detector 24 can be realized by using a detection instrument level bubble detector, as shown in FIG. 7.

Specifically, the horizontal plate 11 can be made of a rectangular steel plate, the size of the rectangular steel plate is determined by specific engineering, the length of the rectangular steel plate is the interval length of the two main reinforcements 2, the width of the rectangular steel plate is 42 mm which is slightly larger than the diameter of the open flexible pipe 5, and the rectangular steel plate is 3 mm in thickness.

It should be illustrated that in other embodiments, the horizontal plate can also be realized by using steel plates of other shapes.

In order to prevent the open flexible pipes from being overhung out of the pile, the open flexible pipes are designed in the pile body, the static loading process can be conveniently and smoothly implemented, and the compression amount of the pile body on the upper portions of the open flexible pipes can be ignored. The device for testing the compression amount of a pile body of a rock-socketed cast-in-place pile further comprises a hoop 4, the hoop 4 is arranged at the upper ends of the second sealing sheets 10 and used for limiting compression deformation of the concrete pile body on the upper portions of the open flexible pipes 5.

In specific implementation, the hoop is of an annular structure, the outer diameter is the same as the pile diameter, and the inner diameter is ⅔ of the pile diameter. For example, the thickness is about 200 mm.

In specific implementation, the length of the closed rigid pipe is the length of the open flexible pipe minus the length of the displacement sensor and then plus a set length threshold value (eg. 3 mm). Wherein, the set length threshold considers the need for pre-compression of the displacement sensors, and the displacement sensors are prevented from being not in contact with the closed rigid pipes.

Figure 8:
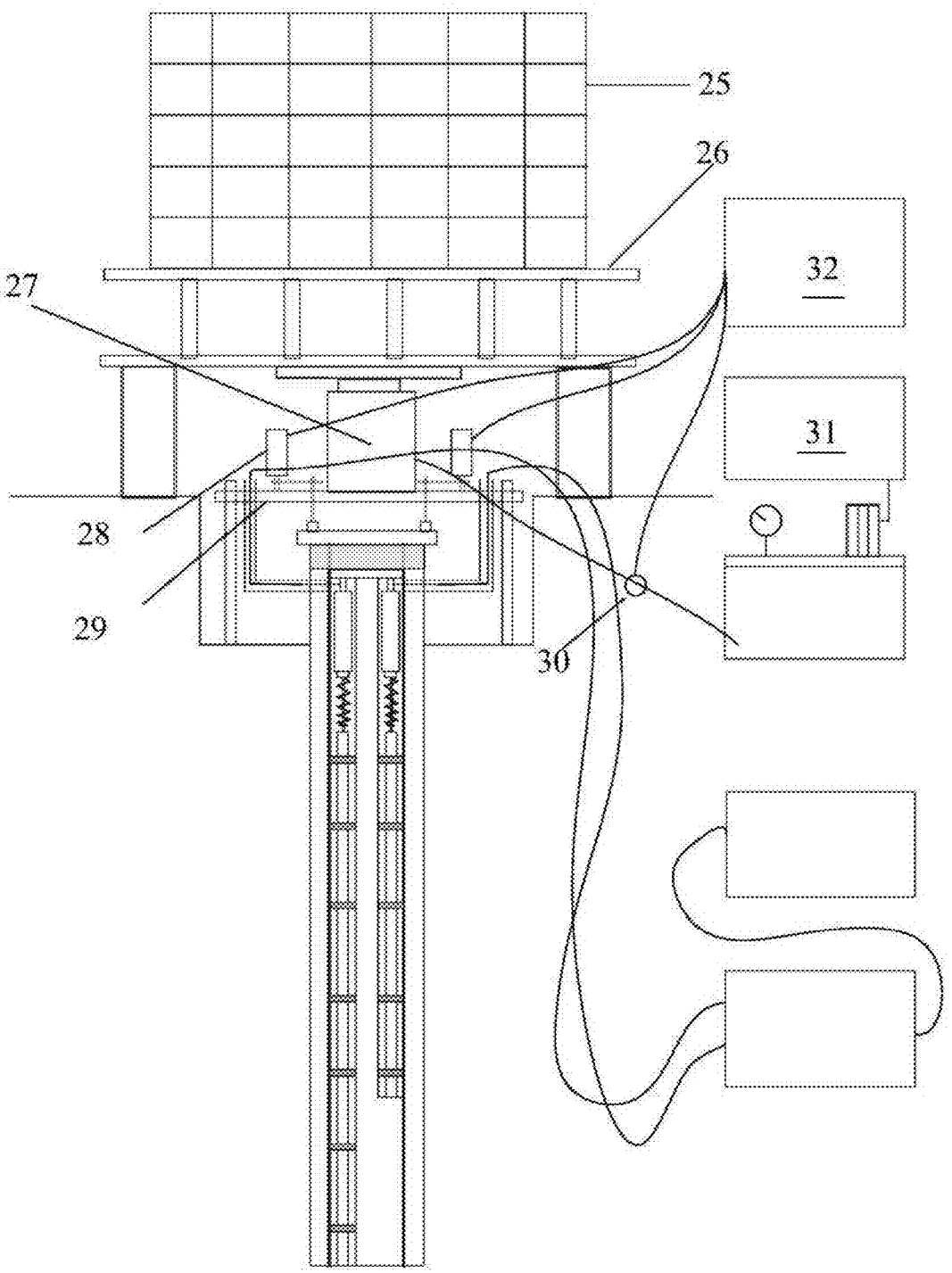
FIG. 8 is a front view of static load equipment and a testing device provided by the embodiment of the present disclosure.

As shown in FIG. 8, a testing method adopting a device for testing the compression amount of a pile body of a rock-socketed cast-in-place pile comprises the following steps:

carrying out a static load test by using the device for testing the compression amount of a pile body of a rock-socketed cast-in-place pile according to any one of claims 1 to 9 to obtain the pile body compression amount $\alpha_1$ of the whole pile and the pile body compression amount $\alpha_2$ above the rock-socketed section; and subtracting the pile body compression amount $\alpha_2$ above the rock-socketed section from the pile body compression amount $\alpha_1$ of the whole pile to obtain the compression amount $\alpha$ of the rock-socketed cast-in-place pile in a rock stratum is obtained and finally obtain Q-$\alpha_1$ and Q-$\alpha$ curves, wherein Q is the balance weight of the static load test.

For example, a rock-socketed cast-in-place pile with the pile length of 13 m and the pile diameter of 1000 mm is adopted in a certain project, and the pile body height of the rock-socketed section is 1.3 m, the distance between the main reinforcements close to the two sides of the central position of the rock-socketed cast-in-place pile is 20 cm according to a design drawing. In order to detect the compression amount of the pile body of the rock-socketed cast-in-place pile and the pile body of the rock-socketed section in the static load test process, before the rock-socketed cast-in-place pile is poured, related accessories are prefabricated and assembled in a prefabrication factory.

The specific procedure for the assembly of the device for testing the compression amount of a pile body of a rock-socketed cast-in-place pile before testing comprises the following steps:

step one, prefabricating a thick steel plate with an annular structure, namely a hoop 4 with the outer diameter of 1000 mm, the inner diameter of 650 mm and the thickness of about 200 mm, wherein considering that the test purpose is to measure the compression amount of a pile body of a 13 m rock-socketed cast-in-place pile and a pile body of a 1.3 m rock-socketed section in the static load test process, the hoop 4 is designed to be arranged on the upper portion of the original pile length, and the actual pile length is 13000 mm plus 200 mm; considering that a reinforcement cage is hoisted in three sections of 5 m, 4 m and 4 m from bottom to top, six open flexible pipes 5 with the diameter of 40 mm, the lengths of 5 m, 4 m and 4 m and the lengths of 3.7 m, 4 m and 4 m need to be manufactured; the six closed rigid pipes 7 are 20 mm in diameter, 5 m, 4 m and 3.803 m in lengths, 3.7 m, 4 m and 3.803 m in lengths (the fiber bragg grating displacement sensor 9 is 20 cm in length, and the fiber bragg grating displacement sensor 9 is pre-compressed by 3 mm) need to be manufactured; two first sealing sheets 6 and two second sealing sheets 10 with the diameter of 41 mm need to be manufactured; an upper annular sheet 17 and a lower annular sheet 20 with the inner diameter of 20 mm, the outer diameter of 15 mm and the thickness of 2 mm, and a plurality of balls 18 with the diameter of 9 mm need to be manufactured; Two PVC pipes with the diameters of 9 mm, comprising two L-shaped converters 23, vertical pipes 22 with the lengths of 800 mm, transverse pipes with the lengths of 1000 mm, need to be manufactured; and a horizontal plate 11 (such as a rectangular steel plate) with the length of 200 mm, the width of 42 mm and the thickness of 3 mm need to be manufactured;

step two, welding two open flexible pipes 5 with the lengths of 5 m with the first sealing sheets 6;

step three, assembling and installing the positioner 8 and the six closed rigid pipes 7, installing the first positioner of each closed rigid pipe 7 at a position 300 mm away from the top end of the closed rigid pipe 7, and then installing the positioners 8 in sequence at intervals of 500 mm; during installation, welding the upper annular sheet 17 and the lower annular sheet 20 to the closed rigid pipe 7 at an interval of 10 mm up and down, and then installing the balls 18 filled with lubricating grease 19;

right now, prefabricating and assembling the related accessories in the prefabrication factory substantially, and then carrying out on-site assembly; and completing the installation of the open flexible pipes 5 of the reinforcement cage on the lowest side;

step four, binding two open flexible pipes 5 with the lengths of 5 m and 3.7 m with main reinforcements close to the two sides of the central position of the rock-socketed cast-in-place pile, during binding, firstly binding the open flexible pipes 5 on one side with iron wires 3, then placing a horizontal plate 11 (such as a rectangular steel plate) on the tops of the open flexible pipes 5, placing a level bubble detector 24 on the horizontal plate 11 (such as a rectangular steel plate), and adjusting the positions of the open flexible pipes 5 on the other side of the lower portion of the rectangular steel plate 11, so that the bubble in the level bubble detector 24 is centered, and then the open flexible pipes 5 on the other side are bound; ensuring that the two open flexible pipes 5 are at the same horizontal height, and after binding is completed, taking down the level detector 24 (such as a level bubble detector) and the horizontal plate 11 (such as a rectangular steel plate); and completing the installation of the open flexible pipes 5 of the reinforcement cage in the middle;

step five, imitating the fourth step to bind two open flexible pipes 5 with the lengths of 4 m, and welding the open flexible pipes 5 of the reinforcement cage on the lowest side and open flexible pipes 5 of the reinforcement cage in the middle; and completing the installation of the open flexible pipes 5 of the reinforcement cage on the upper portion;

step six, imitating the fourth step and the fifth step to bind two open flexible pipes 5 with the lengths of 4 m; forming a small hole with the diameter of 8 mm in the position 50 mm away from the top of the open flexible pipe 5; and then welding the open flexible pipes 5 of the reinforcement cage in the middle and the open flexible pipes 5 of the reinforcement cage on the upper portion;

step seven, hoisting and slowly putting down the combinations of the two closed rigid pipes 7 with the lengths of 5 m and 3.7 m and the positioner 8 in the open flexible pipes 5, and welding the combinations of the two closed rigid pipes 7 with the lengths of 5 m and 3.7 m and the positioner 8 to the combinations of the two closed rigid pipes 7 with the length of 4 m and the positioner 8 at the position 1 m higher than the ground; and continuously lowering to the position 1 m higher than the ground, respectively welding the combinations of the two closed rigid pipes 7 with the lengths of 9 m (5 m plus 4 m) and 7.7 m (3.7 m plus 4 m) and the positioner 8 with the combinations of the two closed rigid pipes 7 with the lengths of 3.803 m and the positioner 8, and then lowering to be in contact with the first sealing sheet 6; and step eight, assembling the fiber bragg grating displacement sensor 9 and the second sealing sheet 10, placing the base of the fiber bragg grating displacement sensor 9 on the second sealing sheet 10, enabling the central positions of the fiber bragg grating displacement sensor 9 and the second sealing sheet 10 to coincide, then carrying out welding, and welding the combined structure of the fiber bragg grating displacement sensor 9 and the second sealing sheet 10 on the open flexible pipe 5;

step nine, enabling an armored optical fiber 13 on the fiber grating displacement sensor 9 to penetrate out along a small hole in the top of the open flexible pipe 5 and to be introduced into the transverse pipe 21 of the PVC pipe 12, and embedding the transverse pipe 21 into the open flexible pipe 5 by 1-2 mm along the small hole; Then assembling the L-shaped converter 23 and the vertical pipe 22, and leading the armored optical fiber 13 out of the ground; and after the PVC pipe is installed, carrying out supporting and reinforcing to guarantee that displacement does not occur when concrete is poured;

step ten, welding the horizontal plate 11 and the second sealing sheet 10; and step eleven, pouring concrete, when the concrete is poured to the horizontal plate 11, stopping pouring, placing the steel hoop 4, and then continuing to pouring the concrete to the top elevation of the steel hoop 4.

By adopting the steps, the assembly of the device for testing the compression amount of a pile body of a rock-socketed cast-in-place pile is completed.

In specific implementation, after a rest period, the rock-socketed cast-in-place pile 1 is subjected to low-strain detection by adopting the device for testing the compression amount of a pile body of a rock-socketed cast-in-place pile 1.

After the low-strain detection is qualified, a static load test is carried out. Wherein, a static load test device is composed of a balance weight 25, a steel beam 26, a jack 27, displacement sensors 28, a datum line beam 29, a high-pressure oil pipe 30, an oil pump controller 31 (the model of which is JCQ-500) and a static load tester 32 (the model of which is JCQ-503E).

The pile body compression amount $\alpha_1$ of the whole pile and the pile body compression amount $\alpha_2$ above the rock-socketed section are subtracted to obtain the compression amount $\alpha$ of the rock-socketed cast-in-place pile in the rock stratum. And finally, Q-$\alpha_1$ and Q-$\alpha$ curves are obtained. Wherein, Q is the balance weight of the static load test.

The foregoing descriptions are merely exemplary embodiments of the present disclosure, but are not intended to limit the present disclosure, and for the skill in the art, the present disclosure can be of various modifications and changes. Any modification, equivalent replacement, or improvement made without departing from the spirit and principle of the present disclosure shall fall within the protection scope of the present disclosure.

What is claimed is:

1. A device for testing the compression amount of a pile body of a rock-socketed cast-in-place pile, comprising open flexible pipes, closed rigid pipes, first sealing sheets, second sealing sheets and displacement sensors, wherein the open flexible pipes are correspondingly bound with two main reinforcements in the pile body of the rock-socketed cast-in-place pile, and lengths of the open flexible pipes are the same as those of the bound main reinforcements; the length of one of the main reinforcements is a height of the rock-socketed cast-in-place pile, and the length of an other of the main reinforcements is the height of the rock-socketed cast-in-place pile minus the height of a rock stratum; one end of each of the two open flexible pipes is located at a bottom end of a corresponding main reinforcement and fixedly connected with the first sealing sheet, and the other ends of the two open flexible pipes are located at a top portion of the rock-socketed cast-in-place pile and fixedly connected with the second sealing sheets; the closed rigid pipe is located in the open flexible pipe, pipe bodies of the closed rigid pipe and the open flexible pipe are not in contact, and the bottom end of the closed rigid pipe and the bottom end of the open flexible pipe are connected together through the first sealing sheet; one end of each of the displacement sensors is fixedly connected with the second sealing sheet, the other ends of the displacement sensors are connected with the top ends of the closed rigid pipes, and the top ends of all the closed rigid pipes are always kept at the same height; and the displacement sensors are used for measuring a relative displacement of the first sealing sheets and the second sealing sheets, namely the compression amount of the pile body.

2. The device for testing the compression amount of a pile body of a rock-socketed cast-in-place pile according to claim 1, wherein the displacement sensor is a fiber bragg grating displacement sensor, and the fiber bragg grating displacement sensor further penetrates through a PVC pipe and then is connected with a fiber bragg grating demodulator through an armored optical fiber.

3. The device for testing the compression amount of a pile body of a rock-socketed cast-in-place pile according to claim 1, wherein a positioner is further installed on the closed rigid pipe and used for guaranteeing that the closed rigid pipe is always located at a central position of the open flexible pipe.

4. The device for testing the compression amount of a pile body of a rock-socketed cast-in-place pile according to claim 3, wherein the positioner comprises an upper annular sheet, a lower annular sheet and balls, the balls are uniformly distributed between the open flexible pipe and the closed rigid pipe, and two ends of the balls are fixed by the upper annular sheet and the lower annular sheet respectively.

5. The device for testing the compression amount of a pile body of a rock-socketed cast-in-place pile according to claim 4, wherein gaps between the balls and the open flexible pipe, between the balls and the closed rigid pipe and between the upper annular sheet and the lower annular sheet are filled with lubricating grease.

6. The device for testing the compression amount of a pile body of a rock-socketed cast-in-place pile according to claim 1, further comprising a horizontal plate, wherein the horizontal plate is arranged at upper ends of the second sealing sheets, and a level detector is arranged on the horizontal plate and used for detecting whether the top ends of all the closed rigid pipes are kept at the same height or not.

7. The device for testing the compression amount of a pile body of a rock-socketed cast-in-place pile according to claim 1, further comprising a hoop, wherein the hoop is arranged at upper ends of the second sealing sheets and used for limiting compression deformation of concrete pile body on upper portions of the open flexible pipes.

8. The device for testing the compression amount of a pile body of a rock-socketed cast-in-place pile according to claim 7, wherein the hoop is of an annular structure, an outer diameter is the same as the pile diameter, and an inner diameter is ⅔ of the pile diameter.

9. The device for testing the compression amount of a pile body of a rock-socketed cast-in-place pile according to claim 1, wherein the length of the closed rigid pipe is the length of the open flexible pipe minus the length of the displacement sensor and then plus a set length threshold value.

10. A testing method by using the device for testing the compression amount of a pile body of a rock-socketed cast-in-place pile according to claim 1, comprising following steps:

carrying out a static load test by using the device for testing the compression amount of a pile body of a rock-socketed cast-in-place pile to obtain the pile body compression amount $\alpha_1$ of a whole pile and the pile body compression amount $\alpha_2$ above a rock-socketed section; and subtracting the pile body compression amount $\alpha_2$ above the rock-socketed section from the pile body compression amount $\alpha_1$ of the whole pile to obtain the compression amount $\alpha$ of the rock-socketed cast-in-place pile in a rock stratum is obtained and finally obtain Q-$\alpha_1$ and Q-$\alpha$ curves, wherein Q is a balance weight of the static load test.

11. The testing method according to claim 10, wherein the displacement sensor is a fiber bragg grating displacement sensor, and the fiber bragg grating displacement sensor further penetrates through a PVC pipe and then is connected with a fiber bragg grating demodulator through an armored optical fiber.

12. The testing method according to claim 10, wherein a positioner is further installed on the closed rigid pipe and used for guaranteeing that the closed rigid pipe is always located at a central position of the open flexible pipe.

13. The testing method according to claim 12, wherein the positioner comprises an upper annular sheet, a lower annular sheet and balls, the balls are uniformly distributed between the open flexible pipe and the closed rigid pipe, and two ends of the balls are fixed by the upper annular sheet and the lower annular sheet respectively.

14. The testing method according to claim 13, wherein gaps between the balls and the open flexible pipe, between the balls and the closed rigid pipe and between the upper annular sheet and the lower annular sheet are filled with lubricating grease.

15. The testing method according to claim 10, further comprising a horizontal plate, wherein the horizontal plate is arranged at upper ends of the second sealing sheets, and a level detector is arranged on the horizontal plate and used for detecting whether the top ends of all the closed rigid pipes are kept at the same height or not.

16. The testing method according to claim 10, further comprising a hoop, wherein the hoop is arranged at upper ends of the second sealing sheets and used for limiting compression deformation of a concrete pile body on upper portions of the open flexible pipes.

17. The testing method according to claim 16, wherein the hoop is of an annular structure, outer diameter is the same as a pile diameter, and an inner diameter is ⅔ of the pile diameter.

18. The testing method according to claim 10, wherein the length of the closed rigid pipe is the length of the open flexible pipe minus the length of the displacement sensor and then plus a set length threshold value.

* * * * *